United States Patent [19]

de Weger

[11] 4,115,663

[45] Sep. 19, 1978

[54] DOUBLY BALANCED DEMODULATOR FOR MULTIPLE CHANNEL FM STEREO SYSTEM

[75] Inventor: Dirk de Weger, Buffalo Grove, Ill.

[73] Assignee: Zenith Radio Corporation, Glenview, Ill.

[21] Appl. No.: 729,510

[22] Filed: Oct. 4, 1976

[51] Int. Cl.[2] ..... H04H 5/00

[52] U.S. Cl. ..... 179/15 BT; 179/1 GQ

[58] Field of Search ..... 179/15 BT, 1 GQ, 1 G, 179/100.1 TD, 100.4 ST; 325/36; 329/50

[56] References Cited

U.S. PATENT DOCUMENTS

| | | | |
|---|---|---|---|
| 3,617,641 | 11/1971 | Feit | 179/15 BT |
| 3,822,365 | 7/1974 | Dorren | 179/15 BT |
| 3,934,092 | 1/1976 | Csicsatka | 179/15 BT |

*Primary Examiner*—Douglas W. Olms
*Attorney, Agent, or Firm*—Cornelius J. O'Connor

[57] ABSTRACT

A doubly balanced demodulator for developing four audio difference components from a composite base-band signal comprises a constant current source and a differential amplifier comprised of a pair of transistors. The constant current source is coupled to the emitters of the differential amplifier transistors, the base of one of the amplifier transistors is coupled to the source of composite signal and the base of the other transistor is returned to a source of bias potential. The demodulator further includes a utilization circuit having four input terminals. One transistor of the transistor amplifier pair is coupled to the utilization circuit by a first switch comprising four current splitting transistors while the other differential amplifier transistor is coupled to the utilization circuit via a second switch likewise comprising four current splitting transistors. A switch activating means renders selected ones of the current splitting transistors conductive and, alternately, the remaining ones of the current splitting transistors conductive, to enable the conducting current splitting transistors to translate segments of the composite signal and to collectively apply these segments to the utilization circuit to enable that circuit to develop four audio difference components.

2 Claims, 3 Drawing Figures

COMPOSITE BASEBAND SPECTRUM

DOUBLY BALANCED DEMODULATOR FOR MULTIPLE CHANNEL FM STEREO SYSTEM

CROSS-REFERENCE TO RELATED PATENTS

This application discloses subject matter which relates to subject matter disclosed in U.S. Pat. No. 3,944,747 which issued to Carl G. Eilers as well as to subject matter disclosed in U.S. Pat. No. 3,902,018 which issued to Peter Fockens. Additionally, the subject matter of this application relates to subject matter disclosed in copending application Ser. No. 643,962 now U.S. Pat. No. 4,027,107 which was filed Dec. 24, 1975 in the name of Carl G. Eilers. The aforementioned patents and the Eilers application are assigned to the assignee of this application.

BACKGROUND OF THE INVENTION

The present invention relates to a demodulator for use in a multiple channel frequency modulation stereo receiver. More particularly, it pertains to a doubly balanced demodulator for developing a plurality of audio difference signals for processing by such a receiver.

Present-day broadcast FM stereo features the transmission of a two-channel coherent stereo signal, the modulation function of which may be represented as follows:

$$M'(t) = K'(L+R) + K''(L-R)\sin\omega_s t, \quad (1)$$

where $L$ represents a left side audio signal, $R$ represents a right side audio signal, $\omega_s$ is the radian frequency of a suppressed carrier amplitude modulated subcarrier signal, $t$ is time, and $K'$ and $K''$ are constants. A two-channel stereo receiver responds to a stereo broadcast by demodulating the sum and difference audio terms and then matrixes those two terms in order to yield the fundamental left and right audio signals L and R. This same receiver responds to a monaural FM broadcast by reproducing the same monaural audio signal in both of its output channels.

On the other hand, a monaural FM receiver responds to a two-channel broadcast stereo signal by deriving only the sum term (L+R) represented in equation (1) to reproduce an audio signal representative of the monaural program. The two-channel signal thus is fully compatible with the monaural signal so that a receiver properly designed for one will also receive the other. Further detailed discussion of the foregoing two-channel transmission system and exemplary disclosures of transmitters and receivers for use therewith will be found in the following U.S. Pat. Nos.: 3,257,511 — Adler et al.; 3,257,512 — Eilers; 3,129,288 — DeVries; and 3,151,218 — Dias et al., all of which patents are assigned to the same assignee as the present application.

In the last few years, interest has been evidenced in recording systems wherein a four-channel stereo signal is recorded on magnetic tape. The four different audio signals represent sources respectively located at the left front, right front, left rear and right rear of an originating point. By using four similarly located pick-ups to effect a four-channel recording and, subsequently, a playback arrangement having four separate loudspeakers similarly distributed around a listening point, a four-channel reproduction is obtained.

The advent of four-channel stereo recording and reproduction has naturally led to consideration of the desirability of transmitting and receiving four-channel stereo signals by radio. Because two-channel stereo is now being broadcast by many FM transmitting stations, attention has been directed particularly to the possibility of utilizing broadcast stations in that category of service for the transmission of four-channel stereo in addition to, or instead of, the transmission of two-channel stereo or monaural signals. To accomplish such a transmission a complex composite baseband signal must be developed in order to accommodate the additional signal components necessary to convey four separate channels of information. At the same time, it is desirable that any four-channel approach be fully compatible both with present two-channel stereo and monaural, so that receiver obsolescence is avoided.

It is also desirable from the standpoint of broadcast station economics, that a commercial four-channel stereo system include provision for an SCA (Subsidiary Communications Authorization) channel. The above-mentioned U.S. Pat. No. 3,944,747 of Eilers, as well as U.S. Pat. No. 3,902,018 of Fockens, both describe four-channel compatible FM stereo systems capable of accommodating SCA.

OBJECTS OF THE INVENTION

It is therefore a general object of the invention to provide a new and improved balanced demodulator for a multiple channel FM stereo system.

It is a specific object of the invention to provide a doubly balanced demodulator for developing four audio difference signals from a source of composite baseband signal.

It is also an object of the invention to provide a doubly balanced four-channel stereo demodulator which is particularly suited for an integrated circuit execution.

SUMMARY OF THE INVENTION

A doubly balanced demodulator for developing a predetermined plurality of audio difference components from a source of composite baseband signal is described. This demodulator comprises a constant current source and a differential amplifier comprising a first signal translating device having at least three electrodes and a second signal translating device also having at least three electrodes. Means for coupling the constant current source to selected like electrodes of the first and second signal translating devices is provided as well as means for coupling the source of composite baseband signal to an input electrode of the first signal translating device. Also included is means for intercoupling the aforesaid like electrodes in addition to means for coupling a first source of bias potential to one electrode of the second signal translating device. The demodulator further comprises a utilization circuit comprising a like predetermined plurality of input terminals and a first switch means comprising a like predetermined plurality of current splitting devices each having an input electrode coupled to the output electrode of the first signal translating device, an output electrode coupled to an assigned one of the utilization circuit input terminals and a control electrode. Second switch means, also included, likewise comprise a like predetermined plurality of current splitting devices each having an input electrode coupled to the output electrode of the second signal translating device, an output electrode coupled to an assigned one of the utilization circuit input terminals and a control electrode. Finally, switch activating means are provided for rendering, at a predetermined repetition rate, selected ones of the current splitting devices conductive, as well as for rendering, alternately and at the same repetition rate, the remaining ones of the current splitting devices conductive to enable these devices to translate segments of the composite signal and to collectively apply these segments to the utilization circuit input terminals to enable the utilization circuit to develop the predetermined plurality of audio difference components.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in conjunction with the accompanying figures, in the several figures of which like reference numerals identify like elements, and in which:

DESCRIPTION OF THE PREFERRED EMBODIMENT

Figure 1:
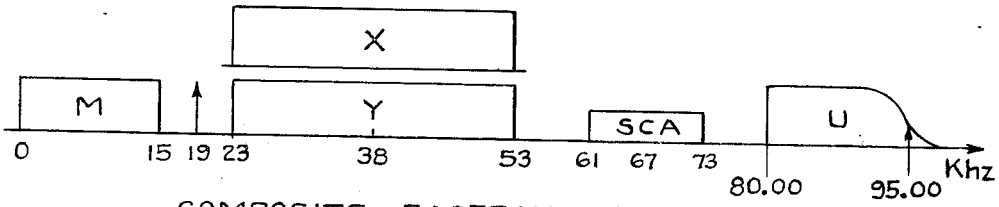
FIG. 1 is a representation of the composite baseband spectrum for a four-channel FM stereo system having provision for an SCA channel.

In order to provide additional background for an understanding of quadraphonic FM, as well as to supplement the present disclosure without burdening it with a repetition of the extensive teaching in the Eilers U.S. Pat. No. 3,944,747 patent, the contents of that patent, as well as the contents of the Fockens U.S. Pat. No. 3,902,018, as represented by their specifications and drawings, are hereby expressly incorporated into this application.

The four-channel stereo system described by Eilers in connection with FIGS. 1–14 in his U.S. Pat. No. 3,944,747 contemplates the generation and etection of a composite quadraphonic baseband signal comprising a carrier that is frequency-modulated by a main channel, by a pair of double sideband suppressed-carrier amplitude-modulated subcarriers of a radian frequency $\omega_s$, in quadrature, and by a double sideband suppressed-carrier amplitude-modulated subcarrier of radian frequency $\omega_{sy}$ which, in a particular embodiment, equals $2\omega_s$. In such a four-channel stereo system, in principle, no frequency selective networks are required for the actual decoding process. Either time division multiplexing (TDM) or frequency division multiplexing (FDM) can be employed for generating the composite baseband signal. A type of receiver employed for detecting and reproducing the four-channel composite signal can, of course, utilize either TDM or FDM circuitry but, in either case it is possible to decode the aforementioned composite baseband signal without the use of frequency selective networks. Thus, a decoder for such a system, whether of the FDM or the TDM type or even a combination thereof, can be of relatively unsophisticated construction and, by resort to monolithic integrated circuitry, a potentially low priced decoder is readily foreseen.

Another approach to four-channel stereo transmission reception is described in connection with FIGS. 15–22 in the Eilers U.S. Pat. No. 3,944,747 patent. In that system the lower sideband of the second subcarrier $\omega_{sy}$ is suppressed so that only the upper sideband, in substance, is transmitted. The purpose in employing upper single sideband transmission is to accommodate the SCA signal which is conventionally located in that portion of the spectrum which would be occupied by the lower sideband of the second subcarrier $\omega_{sy}$. The SCA signal is a double sideband FM subchannel having its subcarrier normally located at 67kHz and having sidebands bracketing the subcarrier and extending from 61 to 73kHz. Eilers recognized that some of the decoder arrangements, described in his U.S. Pat. No. 3,944,747, would decode the SCA signal as if it were a lower sideband of the second harmonic subcarrier thus causing serious interference. To avoid this interference problem Eilers describes in his U.S. Pat. No. 3,944,747 (text material relating to FIGS. 15–22), either a phasing method or a band stop filter method for decoding.

An approach described and taught by Fockens in his patent, which precludes the demodulating decoder from intermixing the SCA and the upper subchannel, contemplates reversing the spectrum of the upper sideband of the upper subchannel of the Eilers composite baseband signal. Specifically, Fockens resorts to a 95kHz subcarrier to generate the upper subchannel and modulates it lower single sideband suppressed carrier to produce a spectrum which would be the same as would be occupied by modulating the upper single sideband on a 75kHz subchannel but with the result, of course, that the location of the audio frequencies is now reversed. Thus Fockens discloses a quadraphonic FM system in which an upper subcarrier frequency is selected such that when modulated its lower sideband does not extend into the spectrum space required for SCA service. To that end, an upper subchannel carrier in the order of 95kHz is proposed since it conveniently comprises the fifth harmonic of the 19kHz pilot signal, which signal must be available in order that the quadraphonic system be compatible with the conventional biphonic system. This 95kHz subcarrier is modulated utilizing a lower single sideband method or, as Fockens prefers, a lower vestigial sideband technique.

Now, the modulation function for the four-channel stereo composite baseband signal, derived in accordance with the teaching of Fockens, can be expressed as follows:

$$f(t)=k[M + Y\sin\omega_s t - X\cos\omega_s t - m\,U\sin\omega_{sy}t + m\,\hat{U}G(\omega)\cos\omega_{sy}t] + S\sin\tfrac{1}{2}\omega_s t - T\sin\omega_{sy}t + V\cos\Omega t \qquad (2)$$

wherein;

$M$ = (LF + RF + LB + RB) Four-element sum component $Y$ = (LF − RF + LB − RB) First difference component $X$ = (LF + RF − LB − RB) Second difference component $U$ = (LF − RF − LB + RB) Diagonal difference component $\hat{U}$ = ($\hat{LF}$ − $\hat{RF}$ − $\hat{LB}$ + $\hat{RB}$), the Hilbert Transform of U $G(\omega)$ = Auxiliary Transfer Function, which is graphically depicted by FIG. 5 in the Fockens patent LF = left-front signal RF = right-front signal $\overline{LB}$ = left-back signal
$\overline{RB}$ = right-back signal
$S$ = 0.1, the first pilot subcarrier amplitude
$T$ = 0.05, the second pilot subcarrier amplitude
$V$ = 0.1, the SCA subcarrier amplitude at a nominal frequency of 67kHz
$\omega_s = 2\pi \times 38{,}000$ radians per second
$\omega_{sv} = 2\pi \times 95{,}000$ radians per second
$\Omega = 2\pi$ 67,000 radians per second
$k$ = modulation constant
$m = 0.7$ A doubly balanced demodulator for use in a quadraphonic FM stereo system, that is a system fully compatible with monophonic and biphonic FM transmissions, will now be described. The composite baseband spectrum of such a quadraphonic FM stereo system, which is mathematically stated by Equation (2), is schematically depicted in FIG. 1. As therein illustrated, the sum component M directly frequency modulates a main carrier, the X and Y difference signals amplitude modulate 38kHz in phase and 38kHz quadrature subcarriers respectively, which, in turn, frequency modulate the main carrier, while the U diagonal difference signal lower vestigial sideband modulates a 95kHz subcarrier which, likewise frequency modulates the main carrier.

Figure 2:
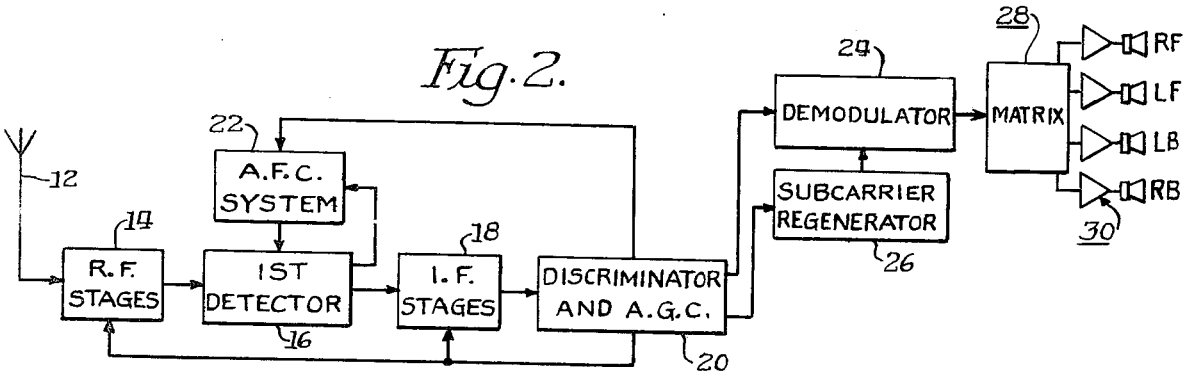
FIG. 2 is a block diagram of a quadraphonic stereo FM receiver capable of retrieving four discrete audio signals from a quadraphonic FM stereo transmission.

FIG. 2 shows, in block diagram form, a quadraphonic FM receiver in which the subject doubly balanced demodulator finds particular application. Insofar as this receiver is concerned, suffice it to say that a transmitted quadraphonic FM stereo signal, intercepted by the antenna 12, is translated by one or more radio frequency (RF) stages 14 to a first detector 16. This detector serves to convert the incoming RF signal to an intermediate frequency (IF) which is translated by IF stages 18 to a discriminator and automatic gain control (AGC) network 20. In a conventional manner the AGC portion of stage 20 is utilized to develop a control signal which is fed back to govern the gain of the RF stages and the IF stage to insure application of a constant amplitude signal to the discriminator. Similarly, an AFC system 22 is provided to control the frequency of the local oscillator. To this end the AFC system, in response to signals from the local oscillator of detector 16 and from the discriminator 20, derives a control signal which adjusts the frequency of the oscillator so as to accurately set the response of the detector relative to the frequency of the received broadcast signal.

Figure 3:
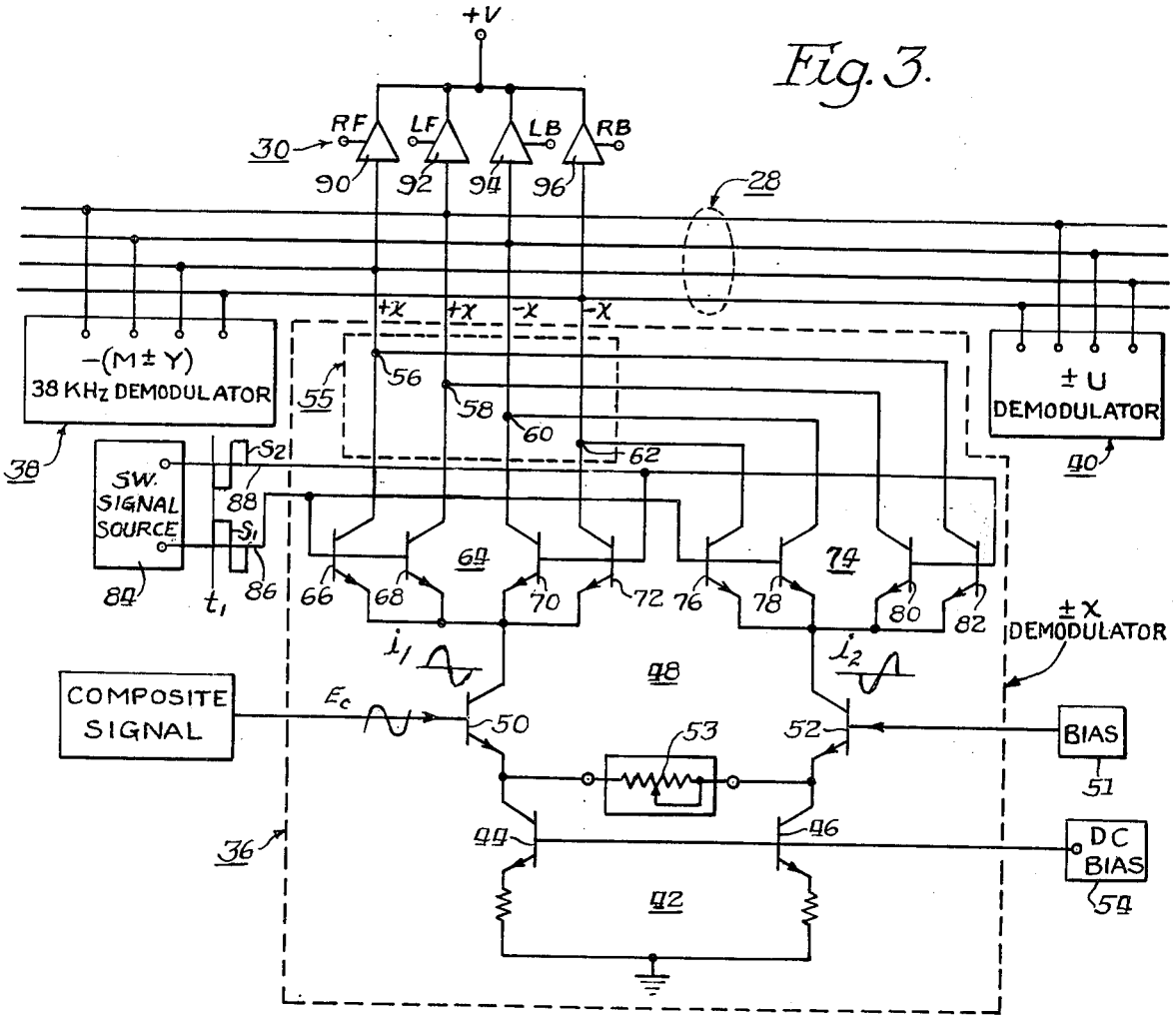
FIG. 3 is a schematic diagram of a doubly balanced demodulator for use in the FM receiver of FIG. 2.

When receiving a quadraphonic stereo broadcast, the composite baseband signal available at the output of the discriminator 20 is that defined by the demodulation function of Equation (2), which, as indicated, includes a 19kHz pilot signal. The composite signal is applied to a demodulator 24 while the pilot signal is applied to a subcarrier regenerator 26 which serves to derive a 38kHz in-phase subcarrier signal, a 38kHz quadrature subcarrier signal and a 95kHz subcarrier signal. These subcarriers are applied as switching signals to the appropriate signal processing circuits in demodulator 24 to effect a synchronous demodulation of the composite baseband signal. As a result, the output of demodulator 24 comprises $-\overline{M}$ sum components, $\pm\overline{X}$ and $\pm\overline{Y}$ difference components and $\pm\overline{U}$ diagonal difference components. These components are applied to a passive matrix 28 which, in turn, derives four discrete audio signals $\overline{RF}$, $\overline{LF}$, $\overline{LB}$ and $\overline{RB}$ for application, through individually assigned units of the amplifier bank 30, to like designated speakers. This derivation obtains by virtue of the addition and subtraction, within matrix 28, of the sum and audio difference components. As shown in FIG. 3 matrix 28 may constitute four conductors to which the indicated combinations of sum, difference and diagonal audio difference components are applied.

Turning now to a consideration of the apparatus for demodulating the $\pm X$ audio difference components, there is disclosed in FIG. 3 a doubly balanced demodulator 36, a signal processing unit of demodulator 24, for developing a predetermined plurality of audio difference components from the source of composite baseband signal, that is, discriminator 20. More particularly, and in a manner to be shown, demodulator 36, in response to a 38kHz quadrature drive signal, serves to develop, at any instant, four audio difference components, specifically two $\pm X$ signals and two $-X$ signals. An X signal, as defined by Equation (2), effectively constitutes front minus back audio information.

Moreover, as indicated in FIG. 3, demodulator 36 is but one of three signal processors employed to supply audio difference components to matrix 28. Demodulator 38 constitutes a second such processor which, in response to a 38kHz in-phase subcarrier signal from regenerator 26, derives a $-M$ four-element sum component, as well as plus and minus versions of the Y (left minus right) audio difference component. Demodulator 40, a third signal processor, responds to a 95kHz subcarrier signal to derive plus and minus diagonal difference components, U signals.

Insofar as the details of demodulator 36 are concerned, this signal processor, in accordance with the invention, contemplates an integrated circuit format comprising a constant current source 42 which includes a pair of active devices, specifically, the transistors 44, 46. While the disclosed dual transistor arrangement is preferred, it is appreciated that a single transistor could be employed as the constant current source. In that case, the single transistor could be connected between the junction of a pair of externally located identical resistors, coupled between the emitters of a differential amplifier transistor pair, and a plane of reference potential. However, this would entail the provision of three terminals on the integrated circuit chip, two to permit connection of the emitters of the transistors of the external resistors and one to effect the mid-point connection of the resistors to the collector of the aforesaid single transistor. Since, in integrated circuit practice it is most desirable to keep connections "to the outside world" at a minimum, and, since the inclusion of an extra transistor is no problem, it is obviously more advantageous to provide a two transistor constant current source and thereby eliminate the third terminal required for a single transistor version of the current source.

Demodulator 36 further includes a differential amplifier 48 comprising a first signal translating device having at least three electrodes, transistor 50, and a second signal translating device also having at least three electrodes, transistor 52. The composite baseband signal from discriminator 20 is applied to the input or base electrode of differential amplifier transistor 50 while the base of differential amplifier transistor 52 is connected to a first source 51 of bias potential. Means in the form of conductors are provided for coupling constant current source 42 to selected like electrodes, i.e., the emitters, of transistors 50, 52. Specifically, the collector of constant current source transistor 44 is conductively coupled to the emitter of differential amplifier transistor 50 while the collector of current source transistor 46 is conductively coupled to the emitter of transistor 52.

Means, in the form of an adjustable resistive impedance 53 is provided for intercoupling the emitters of differential amplifier transistors 52, 52. The emitters of transistors 44 and 46 are individually returned to a plane of reference potential through respective associated resistors as shown in FIG. 3. The bases of transistors 44, 46, which are connected together, are coupled to a second source 54 of DC voltage which serves to establish a forward bias across the base-emitter junctions of these transistors. This bias, of course, is determinative of the value of current supplied by constant current source 42. A utilization circuit 55, comprising a like predetermined plurality of input terminals 56, 58, 60 and 62 is provided for a purpose soon to be made clear.

Interposed between differential amplifier 48 and utilization circuit 55 are a pair of switches. More particularly, a first switch means 64 comprises a like predetermined plurality of current splitting devices which preferably take the form of the four transistors 66, 68, 70 and 72, each of which has an emitter electrode coupled to the collector of differential amplifier transistor 50, an output electrode or collector which is coupled to an assigned one of respective utilization circuit input terminals 56, 58, 60 and 62, and a base which assumes the role of a control electrode.

A second switch means 74 also comprises a like predetermined plurality of current splitting devices, specifically, the four transistors 76, 78, 80 and 82 each also having an emitter electrode coupled to the collector electrode of differential amplifier transistor 52, an output electrode in the form of a collector which is coupled to an assigned one of utilization circuit input terminals 56, 58, 60 and 62, respectively, and a base electrode which serves as a control element.

A switch activating means, or drive 84, for switches 64 and 74, constitutes a source of quadrature subcarrier switching signal, that serves to render, at a predetermined repetition rate, selected ones of the current splitting transistors conductive, as well as to render, alternately and at the same repetition rate, the remaining ones of the current splitting transistors conductive. As will be shown, when they are rendered conductive, the current splitting transistors will translate segments of the composite signal applied to differential amplifier 48 and will collectively apply these segments to the input terminals of utilization circuit 55 to enable that circuit to develop four audio difference signals, i.e., $+x$, $+x$, $-x$ and $-x$. More particularly, a conductor 86 constitutes means for applying to selected ones of the current splitting devices a first subcarrier switching signal $S_1$ in the form of a train of square wave pulses having a 38kHz repetition rate and a phase, which at time $t_1$ is going positive. Since the highest audio frequency employed to modulate the 38kHz subcarrier is not greater than 15kHz, it is evident that the period of a 38kHz gating pulse will always be less (in practice, very much less) than one-half the period of the highest modulating frequency, thus assuring a useful sampling rate for the switching signal. $S_1$ is applied to the control electrodes of selected ones of the current splitting devices, that is, to the bases of transistors 66, 68, 76 and 78.

Another conductor 88 constitutes means for simultaneously applying a second subcarrier switching signal $S_2$ also in the form of a pulse train having a 38kHz repetition rate, but of opposite phase in that it is going negative at time $t_1$, to the control electrodes of the remaining one of the current splitting devices, that is to the bases of transistors 70, 72, 80 and 82. Accordingly, at any instant, two transistors of each of switches 64 and 74 are gated on while the two other transistors are gated off.

Switching signals $S_1$ and $S_2$ thus enable the current splitting transistors to select segments of the composite signal and to collectively apply these segments to the utilization circuit input terminals to enable the utilization circuit to develop the predetermined plurality of audio difference components. Specifically, the collectors of transistors 66 and 82 are connected to utilization circuit input terminal 56, the collectors of transistors 68 and 80 are connected to input terminal 58, the collectors of transistors 70 and 78 are connected to terminal 60 and the collectors of transistors 72 and 76 are connected to terminal 62. Terminals 56, 58, 60 and 62, in turn, are returned to a source of positive potential, $+V$, through respective audio amplifiers 90, 92, 94 and 96.

While it is preferable to employ two oppositely phased pulse trains for signals $S_1$ and $S_2$, it is appreciated that the desired switching action could also be achieved by connecting one of conductors 86 or 88 to a source of DC reference voltage and then applying a square wave pulse train between those two conductors.

In operation, a value of positive potential is selected for $+V$ to the end that desired operating characteristics are obtained for the current splitting transistors of switches 64 and 74, for the transistors of differential amplifier 48 and for the constant current source transistors 44 and 46. Additionally, a DC bias 54 is selected for the bases of transistors 44 and 46 to assure a desired value of constant current from those devices while the bias 51 applied to the base of differential amplifier transistor 52 is chosen to provide a predetermined operating characteristic for that transistor.

The operation of the doubly balanced demodulator 36 will now be described. A 38kHz quadrature subcarrier signal from regenerator 26 is processed by driver 84 to provide the two trains of square wave pulses $S_1$ and $S_2$ of identical repetition rate, but of opposite phase. For purposes of illustration and as shown in FIG. 3, a positive going voltage pulse is applied to conductor 86 while, simultaneously, a negative going voltage pulse is applied to conductor 88. Accordingly, at time $t_1$ this positive going voltage pulse is applied simultaneously to the bases of selected ones of the current splitting devices, namely, transistors 66, 68, 76 and 78 to render them conductive for the duration of the positive pulse. During the same time duration the remaining current splitting transistors 70, 72, 80 and 82 are maintained non-conductive by virtue of the negative pulse applied to their bases. Concurrently, the source of composite baseband signal $E_c$ from discriminator 20 is applied to the base of differential amplifier transistor 50 and also, via the adjustable resistor 53, to the emitter of differential amplifier transistor 52. The signal current $i_1$ then appearing in the collector of transistor 50 is in phase with the input voltage $E_c$ applied to the base of that transistor. On the other hand, the signal current $i_2$ appearing in the collector of transistor 52 is 180° out of phase with respect to composite signal $E_c$.

Now, when a positive pulse from driver 84 is applied to the bases of transistors 66 and 68 segments of positive or, in phase, signal currents $i_1$ are translated by those transistors to their collector circuits. As a result, segments of signal current $i_1$ translated by transistors 66, 68 are collective applied to utilization circuit terminals 56 and 58, respectively, to enable the utilization circuit to develop audio difference components. In this regard, it will be noted that the output leads from terminals 56 and 58 are designated +X to indicate the particular audio difference components developed thereat.

As indicated in FIG. 3, the positive going pulse is simultaneously applied to the base electrodes of current splitting transistors 76 and 78. In this case however, the transistors are translating segments of a composite signal current $i_2$ which are oppositely phased as respects signal current $i_1$. As a result negative segments of signal current $i_2$ are now passed to utilization circuit input terminals 60 and 62. Note that the output leads from terminals 60 and 62 are designated $-x$ to identify the particular audio difference components there developed. Accordingly, during the period of positive pulse application, transistors 66, 68, 76 and 78 are switched or gated on to translate segments of signal currents representative of the composite baseband signal. At the same time, that is during the duration of the positive pulse, a negative going pulse is applied to the base electrodes of transistors 70, 72 and 80, 82 to maintain those transistors non-conductive.

At the termination of the positive pulse on conductor 86 it is replaced by a negative going pulse which switches off transistors 66, 68 and 76, 78. At the same time, the negative going pulse on conductor 88 is replaced by a positive going pulse to render the transistors 70, 72 and 80, 82 conductive. The above described operating mode of the differential amplifier and the current splitting transistors is then repeated but with transistors 70, 72, 80 and 82 now conductive. The net result of the alternate gating of selected current splitting transistors in each of switches 64 and 74 is the derivation of the four audio difference components $+x$, $+x$, $-x$ and $-x$ by the utilization circuit 55.

These four audio difference components are then applied to matrix 28 which effects an algebraic addition of those components with the $-(M \pm Y)$ components and the $\pm U$ components to produce four discrete audio signals. These signals, which are designated RF, LF, LB and RB, are processed by respectively assigned audio amplifiers 90, 92, 94 and 96 and then applied via appropriate power amplifiers (not shown) to the like designated speakers shown in FIG. 2.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A doubly balanced demodulator for developing a predetermined plurality of audio difference components from a source of composite baseband signal comprising:

a constant current source;

a differential amplifier comprising a first signal translating device having first, second and third electrodes and a second signal translating device also having first, second and third electrodes;

means for coupling the source of composite baseband signal to said first electrode of said first signal translating device;

means for coupling a first source of bias potential to said first electrode of said second signal translating device;

means for coupling said constant current source to said second electrode of each of said first and second signal translating devices;

means for intercoupling said second electrodes of said first and second signal translating devices;

a utilization circuit comprising four input terminals;

first switch means comprising four current splitting devices each having an input electrode coupled to said third electrode of said first signal translating device, an output electrode coupled to an assigned one of said utilization circuit input terminals and a control electrode;

second switch means also comprising four current splitting devices each having an input electrode coupled to said third electrode of said second signal translating device, an output electrode coupled to an assigned one of said utilization circuit input terminals and a control electrode; and switch activating means for rendering, at a predetermined repetition rate, selected ones of said current splitting devices conductive and for rendering, alternately and at said same repetition rate, the remaining ones of said current splitting devices conductive to enable said current splitting devices to translate segments of said composite signal and to collectively apply said segments to said utilization circuit input terminals to enable said utilization circuit to develop said predetermined plurality of audio difference components.

2. A doubly balanced demodulator as set forth in claim 1 in which said switch activating means comprises a first means for applying a switching signal of a predetermined repetition rate and phase to the control electrodes of selected ones of said current splitting devices, and a second means for simultaneously applying a switching signal of a like repetition rate, but of a different phase to the control electrodes of the remaining ones of said current splitting devices and, in which said output electrodes of a first and a second of said selected ones of said current splitting devices of said first switch means are individually and respectively coupled to the same utilization circuit input terminals as the output electrodes of a third and a fourth of said remaining ones of said current splitting devices of said second switch means and, in which said output electrodes of a first and second of said selected ones of said current splitting devices of said second switch means are individually and respectively coupled to the same utilization circuit input terminals as the output electrodes of a third and fourth of said remaining ones of said current splitting devices of said first switch means.

* * * * *